United States Patent [19]

Borges

[11] Patent Number: 4,867,697

[45] Date of Patent: Sep. 19, 1989

[54] SELF-LOCKING, TWO-PART ELECTRICAL CONNECTOR EMPLOYING RECEPTACLE WITH SPRING-BIASED WEDGE FOR EXPANDING PLUG'S BLADES

[75] Inventor: Albert Borges, Ben Lomond, Calif.

[73] Assignee: Al-Ray Development, Ben Lomond, Calif.

[21] Appl. No.: 218,555

[22] Filed: Jul. 12, 1988

[51] Int. Cl.[4] ..... H01R 13/15

[52] U.S. Cl. ..... 439/265; 439/259; 439/268

[58] Field of Search ..... 439/259, 263, 264, 345, 439/346, 370, 266, 268, 270

[56] References Cited

U.S. PATENT DOCUMENTS

| | | | |
|---|---|---|---|
| 1,987,772 | 1/1935 | Eberhardt | 173/332 |
| 2,049,093 | 7/1936 | Thorin | 439/259 |
| 2,180,569 | 11/1939 | Walls | 173/361 |
| 2,199,599 | 5/1940 | Stambaugh | 173/330 |
| 2,262,272 | 11/1941 | Eaton | 173/332 |
| 3,643,202 | 2/1972 | Coon | 439/263 |
| 3,710,304 | 1/1973 | Warner et al. | 339/74 R |
| 4,482,789 | 11/1984 | McVey | 200/44 |
| 4,627,681 | 12/1986 | Hong | 339/75 |

*Primary Examiner*—Neil Abrams
*Assistant Examiner*—Khiem Nguyen
*Attorney, Agent, or Firm*—David Pressman

[57] ABSTRACT

A two-part, self-locking electrical connector (10) consists of a male plug (12) with prongs (16, 18, 20) and a female receptacle (14) with sockets and contact blades (28, 30, 32), which engages the respective prongs. The female receptacle has a self-locking device which automatically locks both parts of the connector after insertion of the prongs (16, 18, 20) into respective sockets for electric contact with the blades (28, 30, 32). The self-locking device comprises a rectangular block (48) located in a recess (44) of the receptacle's body. The block is constantly urged toward the prongs by a compression spring (56). The block has tapering side surfaces (58, 60), which exert wedging action to expand the prongs, so that the prongs are pressed against the blades and are maintained in this position by a frictional force which is increased by the action of the spring (56).

15 Claims, 4 Drawing Sheets

12
18
30
28
62
16
18
58
60
46
54
44
56

12
20
51
52
30
50
46
52
54
56

66
68
68
64

SELF-LOCKING, TWO-PART ELECTRICAL CONNECTOR EMPLOYING RECEPTACLE WITH SPRING-BIASED WEDGE FOR EXPANDING PLUG'S BLADES

BACKGROUND

1. Field of the Invention

The present invention relates to electrical connectors, particularly to self-locking, two-part electrical connectors which have means for preventing the connector halves from accidental disconnection.

2. Description of Prior Art

Electric appliances and tools, used nowadays for many purposes, derive their power from electrical outlets, to which the appliances are connected via electrical cords. A cord typically comprises a male plug and wire connecting it to the appliance or tool, while a female receptacle is usually associated with a wall outlet or another cord, such as an extension cord.

In use, the connection between the mating parts often becomes loose over a period of time, or they can be accidentally disconnected. At the best, this occurrence can be a nuisance, but in some cases it may have more serious consequencies, such as loss of valuable information from a computer, or creation of a hazardous condition. Therefore, it would be desirable to have two-part connectors with means for reliably locking the male and female parts against unintentional separation.

Heretofore, many such connectors have been known and used for connection of tools and appliances to the source of electric power. For example, U.S. Pat. No. 3,710,304 to J. Warner, et al., 1973, describes a female plug which has a pushbutton on the outer side of the plug body for engagement and disengagement and a toggle arrangement within the body for frictionally fixing prongs of the male plug from slipping out of the female receptacle. However, the Warner device has a complicated construction, a large number of moveable parts with pivotal connections, and, therefore, a limited number of engagement/disengagement cycles.

The above disadvantages have been eliminated in the self-locking, two-part electrical connector shown in U.S. Pat. No. 4,627,681 to D. Hong, 1986. One of the embodiments shown in that patent comprises a male plug, a female socket, and a spring-loaded moveable wedge mechanism in the socket for pressing the blades in the female socket against the prongs of the plug when the connector halves are mated. The spring-loaded wedge mechanism consists of a pushbutton located on the outer side of the female socket facing the mating male plug, and a wedge element inside the female socket which in the coupled position engages cam followers on the female blades and presses them tightly to the male plug prongs.

Although this connector has a rather simple construction, it is unreliable in operation, and will have a short life. It is unreliable because after withdrawal of the plug, the wedge element may remain jammed between the camming elements of the socket, and it has short life because the camming or wedging force is applied to contact blades of the socket, rather than directly to prongs of the plug. The contact blades of the socket are usually rigidly fixed or molded within the receptacle's body, i.e., they are not yieldable, as are the prongs of the plug, and therefore repeated deformations may lead to concentrations of stress, generation of fatigue stress, resulting in cracks and loose connections.

Other types of locking connectors have been proposed, such as the type where the male plug is inserted and then twisted to lock it in position. However, this "twist-lock" device required a special additional motion to lock it, its operation is affected by wear, it is sometimes unreliable in that the halves separate unintentionally, and expensive adaptors are required to attach it to most types of equipment.

OBJECTS AND ADVANTAGES OF THE INVENTION

Accordingly, it is an object of the invention to provide a two-part, locking electrical connector which is simple in construction, easy to manufacture, reliable in operation, and lasting in service. Another object is to provide a locking connector in which the wedging force is transmitted to prongs of the male plug, rather than to blades of the female receptacle. A further object is to provide a self-locking electrical connector where the locking operation is automatic, yet reliable, simple, and secure. Still further objects and advantages of the present invention will be understood after consideration of the drawings, ensuing description, and claims.

DRAWINGS

REFERENCE NUMERALS USED IN THE DESCRIPTION AND DRAWINGS

Figures 1, 2:
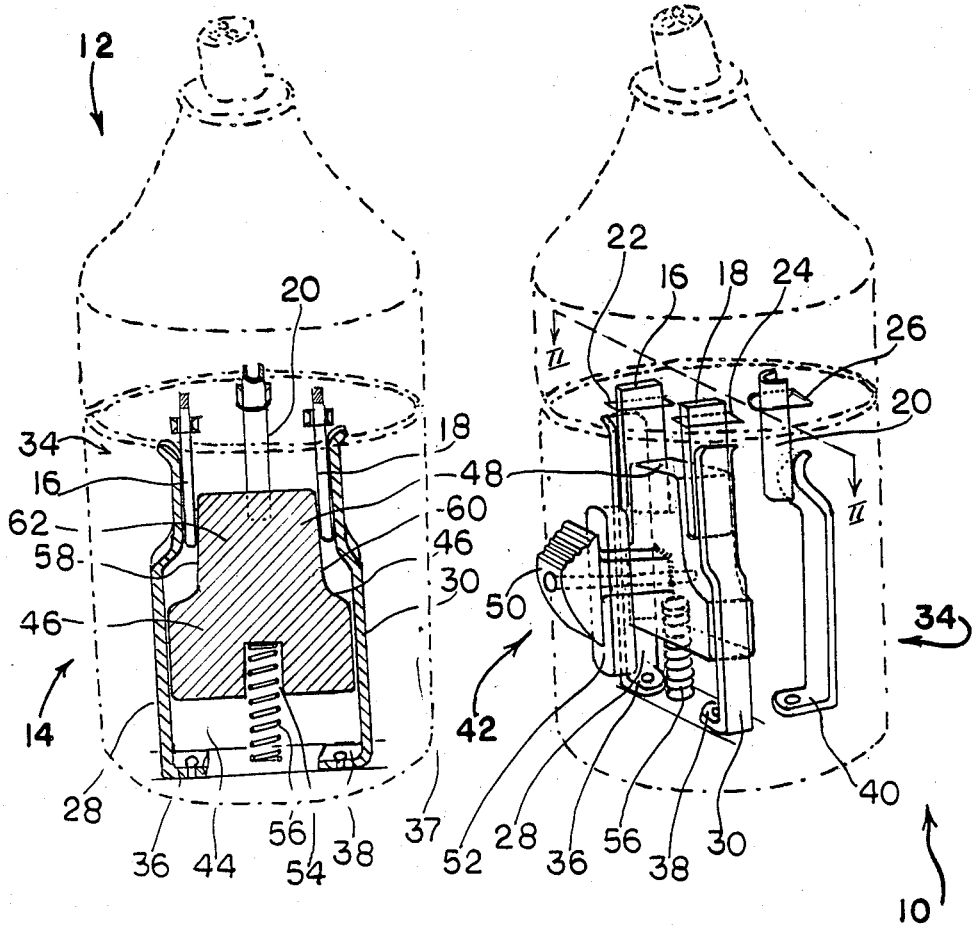
FIG. 1 is a perspective view of a two-part, self-locking connector of the invention in a coupled state.
FIG. 2 is a sectional view taken along line II—II of FIG. 1.

10 - electrical connector
12 - male plug
14 - female receptacle
16 - neutral-line prong
18 - hot-line prong
20 - grounding-line prong
22 - neutral-line socket
24 - hot-line socket
26 - grounding-line socket
28 - neutral-line contact blade
30 - hot-line contact blade
32 - ground-line contact blade
34 - female receptacle body
36, 38, 40 - terminal ends of the contact blades
42 - self-locking element
44 - rectangular slide recess
46 - wedge
48 - rectangular block
50 - button
51 - neck portion
52 - slot
54 - recess
56 - spring 58, 60 - side tapering surfaces
62 - upper portion of the block
64 - wall-type receptacle
66 - screw
68 - head of the slide block

DESCRIPTION—TWO-PART, SELF-LOCKING CONNECTOR

A two-part, self-locking connector of the invention is shown in FIGS. 1 and 2, wherein FIG. 1 is a perspective view of the connector in a coupled state, and FIG. 2 is a sectional view along line II—II of FIG. 1. For the sake of clarity, in both drawings, the connector's external bodies are shown by broken lines.

The electrical connector, which in general is designated by reference numeral 10, comprises a male plug 12 and a female receptacle 14. In the form of the invention shown, the connector is of a "grounded" type in that its male plug 12 has three prongs, i.e., prongs 16 and 18 which are connected inside plug 12 to neutral and hot wires (not shown), respectively, and a prong 20 for a grounding line (also not shown). Female receptacle 14 has sockets 22 and 24 which mate with prongs 16 and 18, respectively, and a grounding socket 26 for mating with grounding prong 20.

Each socket 22, 24, and 26 of female receptacle 14 accommodates a respective female contact blade, i.e., a contact blade 28 is in socket 22, a contact blade 30 is in socket 24, and a contact blade 32 is in socket 26. The blades are made from a rigid material having high electrical conductivity, i.e., from brass, copper, etc. The blades are fixed in a female receptacle body 34 which is outlined by broken lines and which can be made, e.g., from rubber or plastic material with insulating properties. Each female contact is held in a manner that it does not prevent insertion of the respective male prongs, but slightly protrudes inwardly in the path of its mating prong. Terminal ends 36, 38, and 40 of the contact blades are connected to lead wires (not shown) in a conventional manner.

The construction which has been described above is essentially the same as in any conventional "grounded"-type connector. A distinguishing feature of the invention is a self-locking mechanism which will now be described.

A self-locking mechanism 42 is located in a rectangular recess 44 which is formed inside molded body 34 of female receptacle 14 between neutral contact blade 28 and hot contact blade 30. Recess 44 extends in a direction parallel to sockets 22, 24, and 26. Slidingly located inside recess 44 is a wedge 46 which is made from an insulating material, preferably a hard plastic having a moderate-to-high coefficient of friction. Fiberglass-filled nylon is satisfactory. Wedge element 46 consists of a substantially rectangular block 48 which is connected by a neck portion 51 (FIG. 4) to a button 50 which protrudes outside molded body 34 by passing through a longitudinal slot 52 (best seen in FIG. 4) formed in the outer wall of female receptacle 14. Slot 52 extends in a direction parallel to recess 44. On its side opposite to the sockets, block 48 has a recess 54 which accommodates a resilient element, e.g., a compression spring 56, the other end of which rests against the bottom of recess 44. Normally, spring 56 tends to push block 48 upwardly, toward the male plug prongs. Slot 52 provides freedom of movement for neck portion 51 in the axial direction of the receptacle.

Figure 7:
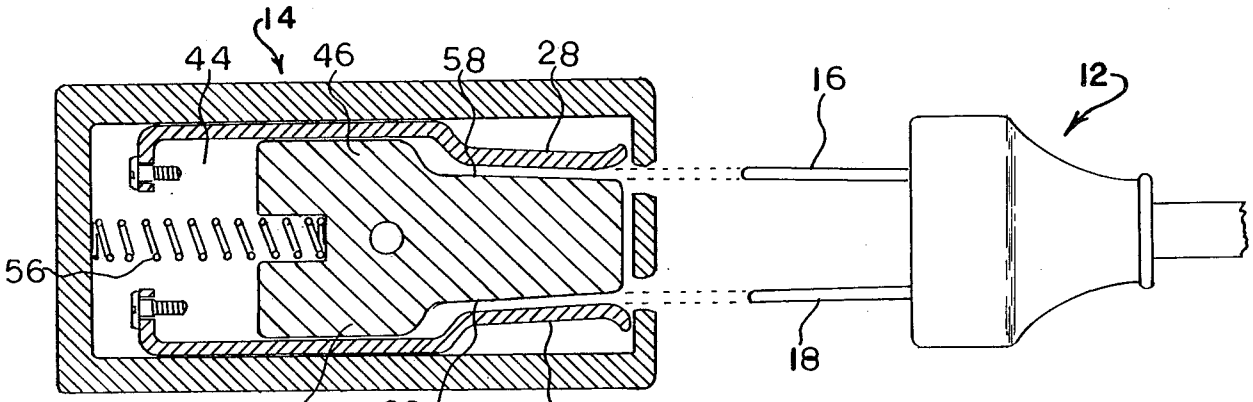
FIG. 7 is a front side view showing the connector halves unmated.

Block 48 has a narrowed upper portion 62 with tapering side surfaces 58 and 60 which face blades 28 and 30, respectively. Upper portion 62 is narrower than the distance between the inner facing sides of prongs 16 and 18. The bottom portion of the block exceeds the above-mentioned distance between inner facing sides of prongs 16 and 18. Thus, in an uncoupled position of female receptacle 14 (FIG. 7) block 48 is urged upwardly by spring 56. Female blades 28 and 30 slope toward each other, parallel to the sides of upper portion 62. Preferably the sides of block 48 are oriented at a narrow angle of 6° to each other and their angled portions are 14 mm long.

OPERATION

Figure 8:
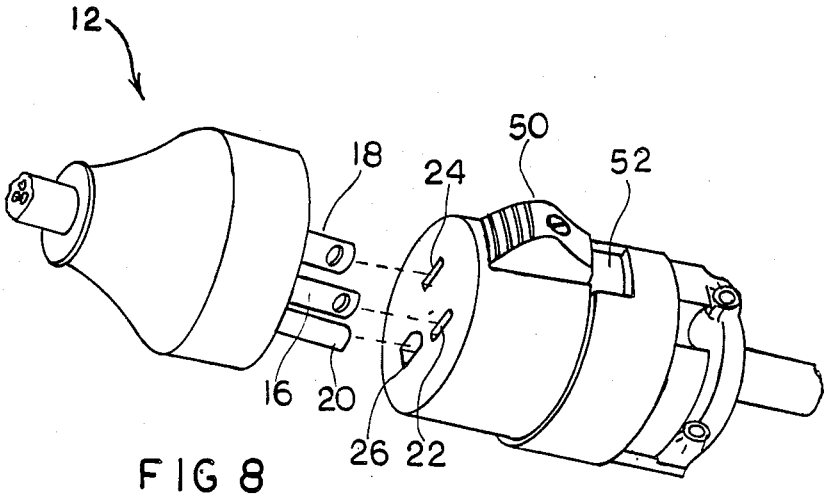
FIGS. 8 and 9 are external perspective views showing the connector halves unmated and mated.

The two-part self-locking connector of the invention operates in the following manner:

For connection of an appliance (not shown) to the source of electric power, male plug 12 (FIG. 8) is electrically coupled to female receptacle 14 by inserting plug 12 so that its prongs 16, 18, and 20 go into respective sockets 22, 24, and 26 of female receptacle 14, as indicated.

Figures 3, 4, 5:
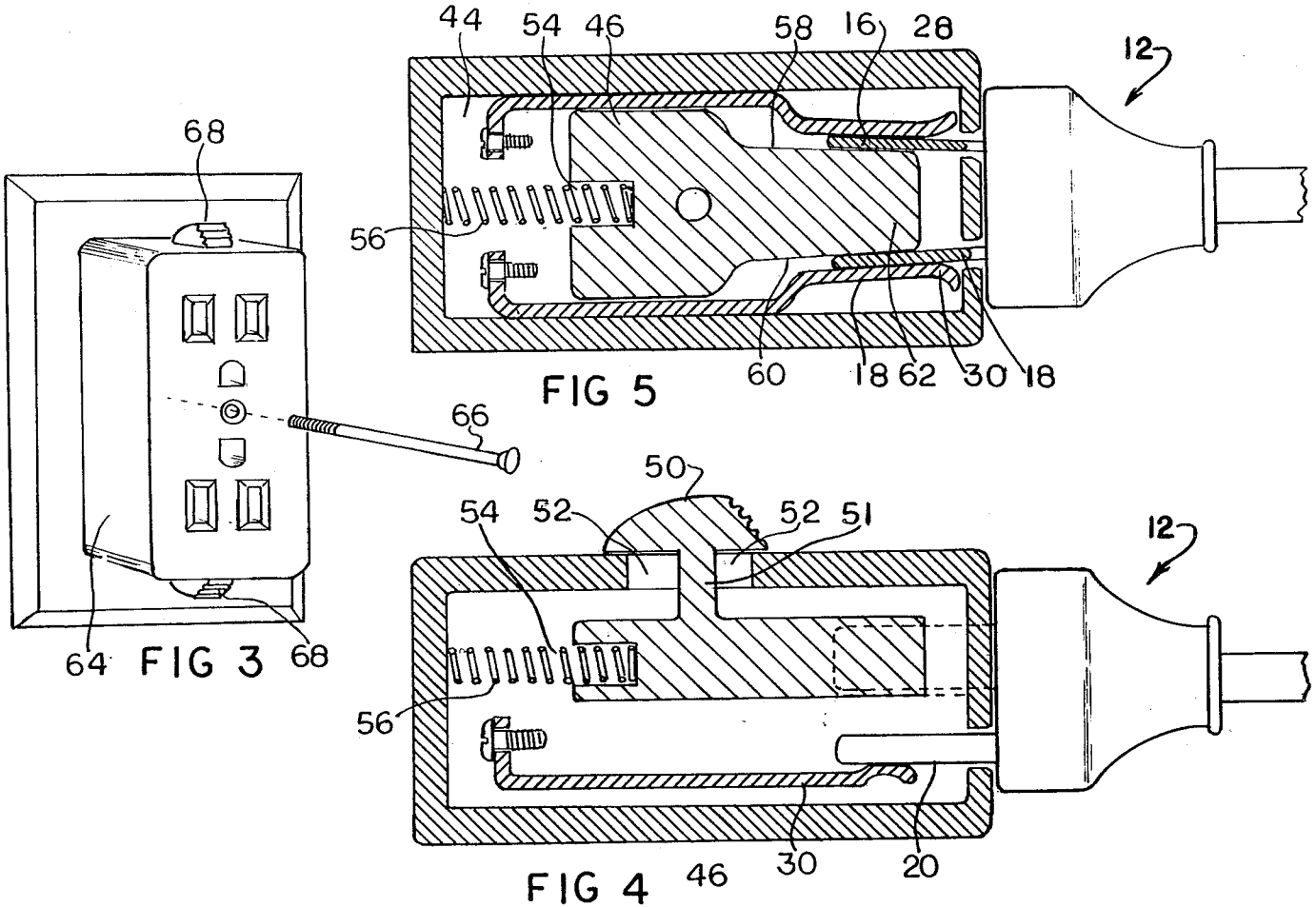
FIG. 3 is a perspective view of a retrofit version of the connector of the invention in the form of an adapter attached to a wall socket.
FIGS. 4 and 5 are sectional right side and front side views showing the connector in its coupled state.

As the male prongs are inserted, they will enter the gaps between side surfaces 58 and 60 of block 48 and respective contact blades 28 and 30. Prongs 16 and 18 will force wedge 46 down partially and will mate with blades 28 and 30, respectively, as best seen in FIGS. 2 and 5. I.e., prongs 16 and 18 overcome the resistance of spring 56 and push block 48 and button 50 down through friction contact between the inner surfaces of the prongs and tapering surfaces 58 and 60 of the block. While block 48 moves down, its head 50 also slides down within slot 52. Insertion of the male prongs is relatively easy, but can be further facilitated by first manually pulling down button 50.

Figure 9:
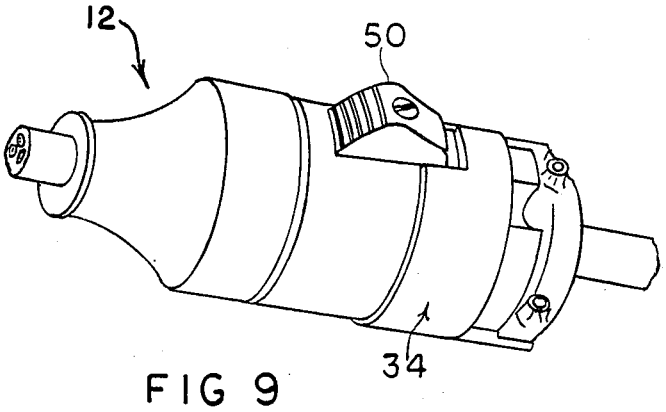

When the male plug is completely at home, both parts of connector 10 are locked in the coupled position because prongs 16 and 18 will be wedged between tapering surfaces 58 and 60 of the block and contact blades 28 and 30. The prongs are kept wedged due to the effect of spring 56. This wedging action can be strengthened by applying an oppositely directed upward force to button 50 after the plug is fully inserted; however, this upward force is not necessary. If one attempts to withdraw the male plug, friction between its prongs 16 and 18 and the sides of wedge block 48 will draw block 48 up with the prongs and thereby push the prongs with even more force against the blades so as to prevent withdrawal of the plug. This is so whether or not an upward force is applied to button 50. The connector is now mated, as shown in FIG. 9.

Reliable contact between grounding prong 20 and respective contact blade 32 is provided because, as has been mentioned above, the normal position of blade is in the path of prong 20.

Figure 6:
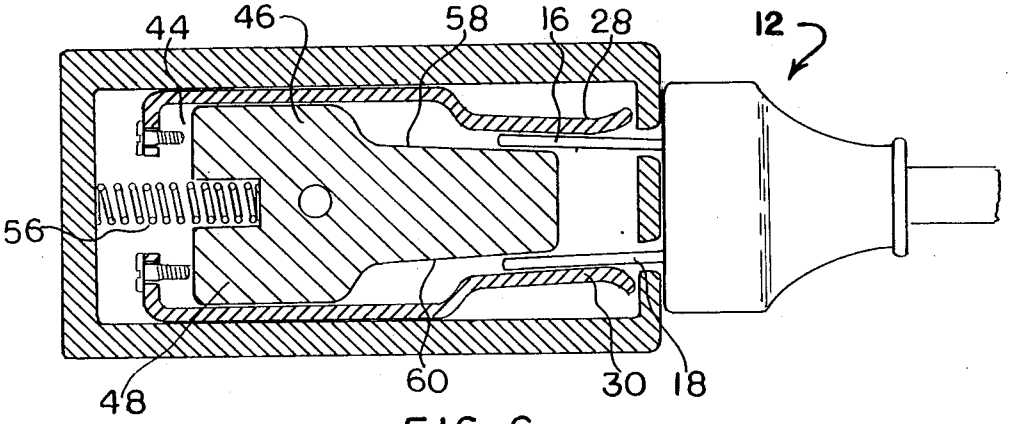
FIG. 6 is a front side view showing the connector with its wedge or locking element drawn back.

To disconnect the connector's parts, head 50 is pulled down by the thumb. This will withdraw block 48 as shown in FIG. 6. Male plug 12 then can easily be removed (FIG. 7), whereafter, when the thumb is removed, the force of spring 56 will return block 48 to its initial position. The connector halves cannot accidentally or intentionally be separated from their mated condition.

The self-locking connector of the invention is simple in construction, reliable in operation, and lasting in service. The wedging force is applied to the prongs of the male plug, rather than to the receptacle's contact blades which are rigidly fixed in the receptacle's body. Therefore the blades are protected from deformation, concentration of stress, etc. The operation of the wedge is automatic, i.e., when the prongs are inserted, they will force it down and spring 56 will then urge it upwardly to maintain the mated condition. If the contacts or the wedge wears, this will have no effect on the locking action since wedge 46 will take up any resulting play. No additional motion or operation (as in the twist lock connector) is required to effect fully-locked mating.

FIG. 3—RETROFIT TO AN EXISTING WALL SOCKET

FIG. 3 shows an embodiment of the invention as a retrofit to an existing wall socket. The connector is formed as an adapter 64 which has male prongs (not shown) on one side and female sockets on the other side.

Because the interior of adapter 64 is the same as that of receptacle 14, only the external appearance of the adapter is shown. Adapter 64 has the same shape and configuration as a conventional adapter which can be plugged into a wall socket. Adapter 64 is installed by removing the existing wall plate screw (not shown), plugging in adapter 64, and fixing adapter 64 in place by a longer screw 66. The moving wedge block (not shown) is located inside the adapter and is operated by buttons 68. The walltype connector of the invention operates in the same manner as the one described in relation to FIGS. 1 and 2.

RAMIFICATIONS AND SCOPE

The present invention has been illustrated in the form of specific embodiments shown in FIGS. 1 to 3. It is understood, however, that these embodiments have been given only as examples and that any other modifications are possible within the scope of the appended claims. For example, the connector may have only two prongs and sockets, i.e., no ground prong or socket, or it may have more than three prongs and sockets. The wedging element may have a round or oval configuration rather than rectangular. Spring 56 may be located in another place or substituted by a pair of springs located on both sides of the wedge. It can be also a leaf spring, or any other resilient element. The plug and receptacle may have a square, rectangular or any other shape required for particular application. Bodies of the connector parts can be made not only from rubber or plastic, but from any other material, provided that live parts are properly insulated. The plug or receptacle may comprise an adapter which is screwed into a conventional lamp socket, etc. The connector may have several circumferentially-arranged prongs and several circumferentially arranged sockets with the wedge element in the form of a conical body of a rotation. The taper angle of the wedge block can vary within a range about the value indicated. The angle should be selected to allow the male prongs to be inserted with minimum force and with minimum spring pressure, yet still achieve adequate damping force against the female contacts. Therefore the scope of the invention should be determined, not by the examples given, but by the appended claims and their legal equivalents.

I claim:

1. A two-part self-locking connector comprising:

a male plug having a body and a plurality of male current-conducting prongs which are insulated from each other inside said body and protrude therefrom;

a female receptacle which has a body and a corresponding plurality of sockets in said body for receiving said male current-conducting elements;

said plurality of sockets containing a respective plurality of contact blades which are insulated from each other and are engageable with said respective male current-conducting prongs when they are inserted into said respective sockets in a given direction, said contact blades being fixed in said body of said female receptacle; and means for urging said male current-conducting prongs against said respective contact blades when said male current-conducting prongs are inserted into said respective sockets;

said means for urging comprising:

a wedge mounted in said body of said female receptacle; and spring biasing means also mounted in said body of said female receptacle;

said spring biasing means positioned and sized to urge said wedge in a direction in which said wedge cams said male current-conducting prongs, when said male current-conducting prongs are inserted into said sockets, in a direction perpendicular to said given direction, away from each other, and against said respective contact blades.

2. The connector of claim 1 wherein said means for urging is mounted entirely in said female receptacle.

3. The connector of claim 2 wherein said spring biasing means urges said wedge toward said male plug when it is mated with said female receptacle.

4. The connector of claim 3 wherein said spring biasing means comprises a coiled compression spring.

5. The connector of claim 2 wherein said wedge has a substantially rectangular shape and a head element, said body of said female receptacle means having an elongated slot, and said head element protruding through said elongated slot out from said body of said receptacle, said elongated slot being oriented in the direction of said blades and enabling movement of said wedge within the limits required for wedging said male current-conducting prongs outwardly against said respective contact blades.

6. The connector of claim 1 wherein said male current-conducting prongs comprise at least three prongs, one of which is a grounding prong, and said female receptacle has at least three sockets with respective blades corresponding to said prongs.

7. The connector of claim 1 wherein said contact blades are spaced so that said male current-conducting prongs will be positioned between said contact blades when said plug is mated with said receptacle, and wherein said wedge is positioned so that it will be between said prongs and said contact blades when said plug is mated with said receptacle.

8. The connector of claim 7 wherein said wedge has a narrow end and a broad end, said spring biasing means is positioned against said broad end of said wedge and is arranged to urge said wedge in a direction toward said plug, when it is mated with said receptacle.

9. A two-part self-locking connector comprising:

a male plug which has a body and current-conducting prongs which are insulated inside said body and protrude therefrom;

a female receptacle which has a body and sockets in said body for receiving and current-conducting prongs, said sockets containing contact blades engageable with said respective current-conducting prongs when said plug is mated with said receptacle, said blades being fixed in said body of said female receptacle; and a wedge for locking said plug and said female receptacle in said inserted position;

said wedge being mounted entirely in said body of said female receptacle, said wedge having tapering side surfaces which are shaped to cam said respective prongs outwardly, away from each other, and against said respective contact blades; and spring biasing means mounted in said female receptacle for urging said wedge in a direction parallel to said contact blades so that the side surfaces of said wedge will push said prongs into tight self-locking contact with said contact blades;

said body of said female receptacle having a recess, said wedge being moveable within said recess.

10. The connector of claim 9 wherein said spring biasing means comprises is a compression spring which is mounted between a bottom of said recess and a larger end of said wedge.

11. The connector of claim 9 wherein said wedge has a substantially rectangular shape and a head, said body of said female receptacle having an elongated slot, and said head protruding through said slot out from said body of said female receptacle, said slot being oriented in the direction of said blades and enabling movement of said wedge within the limits required for urging said prongs outwardly against said contact blades.

12. The connector of claim 9 wherein said current-conducting prongs comprise at least three prongs, one of which is a grounding prong, and said female receptacle means having at least three sockets with blades corresponding to said prongs.

13. A two-part self-locking connector comprising:

a male plug which has a body of an insulating material and a plurality of current-conducting prongs which protrude from said body, one of said prongs being connectable to a neutral load line and another to a hot load line;

a female receptacle which has a body of an insulating material and two sockets in said body for receiving said respective two prongs, said sockets containing respective contact blades engageable with said respective current-conducting prongs when said plug is mated with said receptacle, said contact blades being fixed in said body of said female receptacle, one of said blades being connectable to a neutral supply line and another to a hot supply line, each prong being engageable with a contact blade connected to the line which corresponds to the line of said prong;

a recess formed in said body of said receptacle between said blades which are connected to said neutral and hot lines;

a wedge for locking said plug and said female receptacle in said inserted position, said wedge being mounted in said recess in said female receptacle and between said blades and said prongs when said plug is mated with said female receptacle; a compression spring between the bottom of said recess and said wedge, said wedge being moveable with said recess in a direction parallel to said blades, said wedge having tapering sides facing said respective contact blades, said spring urging said wedge toward said plug such that wedge cams said prongs outwardly against said respective contact blades.

14. The connector of claim 13 wherein said body of said female receptacle has a longitudinal slot parallel to said contact blades, said wedge having a head which protrudes outside of said body, said slot enabling movement of said wedge and its head in a longitudinal direction parallel to said blades and said prongs so that when said prongs are inserted into said sockets, said prongs are locked against said contact blades by frictional force between said tapering surface of said wedge and said prongs.

15. The connector of claim 13 wherein said wedge has a recess on its side opposite to said prongs, one end of said compression spring being inserted into said recess of said wedge.

* * * * *